US009210489B1

(12) United States Patent
Chu et al.

(10) Patent No.: US 9,210,489 B1
(45) Date of Patent: Dec. 8, 2015

(54) OFF-AXIAL AUDIO SPEAKER USING SINGLE AUDIO SOURCE

(71) Applicant: Huiyang Dongmei Audio Products Co., Ltd., Guang Dong (CN)

(72) Inventors: Ming-Chung Chu, New Taipei (TW); Pin-Tang Lee, New Taipei (TW); Taniguchi Shoichi, Nara (JP)

(73) Assignee: HUIYANG DONGMEI AUDIO PRODUCTS CO., LTD., Guang Dong (CN)

( * ) Notice: Subject to any disclaimer, the term of this patent is extended or adjusted under 35 U.S.C. 154(b) by 0 days.

(21) Appl. No.: 14/335,441

(22) Filed: Jul. 18, 2014

(51) Int. Cl.

| | |
|---|---|
| ***H04R 25/00*** | (2006.01) |
| ***H04R 1/00*** | (2006.01) |
| ***H04R 15/00*** | (2006.01) |
| ***H04R 1/24*** | (2006.01) |
| ***H04R 9/06*** | (2006.01) |

(52) U.S. Cl.
CPC .. *H04R 1/00* (2013.01); *H04R 1/24* (2013.01); *H04R 9/063* (2013.01); *H04R 15/00* (2013.01); *H04R 2205/022* (2013.01); *H04R 2205/026* (2013.01)

(58) Field of Classification Search
CPC ..... H04R 1/24; H04R 1/26; H04R 1/323; H04R 1/403; H04R 7/02; H04R 7/122; H04R 9/025; H04R 9/046; H04R 9/063; H04R 2205/022; H04R 2205/026; H04R 2209/041
USPC ..... 381/300, 335, 337, 339, 182, 186, 386, 381/396, 398, 401, 402, 423, 430, 432
See application file for complete search history.

(56) References Cited

U.S. PATENT DOCUMENTS

| | | | | |
|---|---|---|---|---|
| 5,339,286 A * | 8/1994 | Esposto | H04R 1/24 | 181/144 |
| 5,548,657 A * | 8/1996 | Fincham | H04R 1/24 | 381/182 |
| 5,604,815 A * | 2/1997 | Paddock | H04R 9/025 | 381/182 |
| 8,452,032 B2 * | 5/2013 | Varla | H04R 1/24 | 381/182 |

* cited by examiner

*Primary Examiner* — Huyen D Le
(74) *Attorney, Agent, or Firm* — Muncy, Geissler, Olds & Lowe, P.C.

(57) ABSTRACT

The present disclosure provides an off-axial audio speaker using single audio source. The audio speaker includes a bass sounding unit and a treble sounding unit. The bass sounding unit is off-axially surrounded by the treble sounding unit and includes two magnets, a single magnetic gap mechanism, a vibration sounding membrane disposed with a single sound coil, and a wiring board. A magnetic resistance ring is selectively disposed within the bass sounding unit, and the treble sounding unit is disposed in the magnetic resistance ring. The vibration audio source point of the bass sounding unit is horizontally aligned with the vibration audio source point of the treble sounding unit. Therefore, the size of the audio speaker can be reduced, and vibration audio source points are aligned for realizing a relatively broader range of electrical adjustability and enabling the audio speaker to output both bass and treble sound.

17 Claims, 13 Drawing Sheets

OFF-AXIAL AUDIO SPEAKER USING SINGLE AUDIO SOURCE

BACKGROUND

1. Technical Field

The present disclosure relates to a structure of a sounding unit of an audio speaker; in particular, to an off-axial audio speaker using a single audio source. A bass sounding unit is off-axially surrounded by a treble sounding unit for increasing an area of bass sounding, and a bass sound vibration audio source point of the bass sounding unit aligns with a treble sound vibration audio source point of the treble sounding unit to the same horizontal reference level.

2. Description of Related Art

The conventional earphones or audio speakers are equipped with one single amplifier (sounding unit), and that difficult to render the realization of a broad range of listening experience. The certain tradeoff at the expense of the treble performance becomes necessary if the bass performance needs to be enhanced. Even for achieving the goal of the above mentioned broad listening experience, multiple separate sounding units (for example, distinct treble sounding unit and bass sounding unit) need to be placed within the earphones or the audio speakers, occupying additional space inside the earphones or the audio speakers and inevitably increasing the size of the same.

SUMMARY

In order to overcome the aforementioned deficiencies, the present disclosure provides an off-axial audio speaker using one single audio source. A bass sounding unit is off-axially surrounded by a treble sounding unit for increasing a sounding area of the bass sounds and reducing the size of the whole audio speaker. Moreover, the vibration sounding audio source points of the bass sounding unit and the treble sounding unit may be aligned to the same horizontal reference level for making the sounding unit have relatively broader range of electrical adjustability.

An off-axial audio speaker using a single audio source according to the present disclosure may include a treble sounding unit which has a treble vibration audio source point, a treble sound output hole, and a first wiring board. The same audio speaker may also include a bass sounding unit having a treble sound positioning surface which is off-axially disposed and is hollow, for separating the two sides of the treble sound positioning surface into a long-axis sounding surface and a short-axis sounding surface. The long-axis has relatively longer vibration area for increasing the sounding area of the bass sounding unit to reach the optimal bass sound. The bass sounding unit may further include a sounding body which has a magnet, a sound coil, and a vibration sounding membrane. The sounding body may include a bass vibration audio source point. The treble sounding unit is fixed and adjoined with the treble sound positioning surface of the bass sounding unit, allowing for the treble sounding unit to be off-axially positioned in the bass sounding unit. Moreover, the bass vibration audio source point of the bass sounding unit and the treble vibration audio source point of the treble sounding unit are aligned to the same horizontal reference level.

The treble sounding unit may be a moving-iron sounding unit, a circular electromagnetic moving-iron sounding unit, a rectangular electromagnetic moving-iron sounding unit, a moving-coil sounding unit, a ribbon-type sounding unit, a piezoelectric ceramic sounding piece component, a piezoelectric ceramic sounding piece adjoining another vibration sounding membrane, or a semiconductor chip sounding unit.

Specifically, a magnetic resistance ring is disposed at the surrounding and adjoining part between the treble sounding unit and the bass sounding unit, for separating the magnetic field of the bass sounding unit and the magnetic field of the treble sounding unit.

Specifically, the magnetic resistance ring is a sleeve structure which includes an inner part for the treble sounding unit to cross and be positioned and an outer part for a magnetic permeability base of the bass sounding unit to surround and be fixed at.

Specifically, the bass sounding unit includes a circular magnetic permeability base having the treble sound positioning surface which is hollow and is disposed at the off-centric position of a body part of the circular magnetic permeability base, for allowing the treble sounding unit to surround and be fixed at. The body part of the circular magnetic permeability base is disposed with a circular containing space which has a top opening, and includes an inner circular wall and an outer circular wall collectively defining the top opening. The same bass sounding unit further includes an off-centric first circular magnet and an off-centric second circular magnet. The off-centric first circular magnet is disposed at the position of the inner circular wall of the circular containing space, and is adjoined with the inner circular wall. The off-centric second circular magnet is disposed at the position of the outer circular wall of the circular containing space, and is adjoined with the outer circular wall. A magnetic gap is formed between the off-centric first circular magnet and the off-centric second circular magnet. The same bass sounding unit also includes an off-centric first magnetic permeability ring and an off-centric second magnetic permeability ring. The off-centric first magnetic permeability ring is fixed at an upper surface of the off-centric first circular magnet, and the off-centric second magnetic permeability ring is fixed at an upper surface of the off-centric second circular magnet. The bass sounding unit further includes a vibration sounding membrane which has a circular sound membrane. The circular sound membrane is fixed at an edge part of the inner circular wall and the outer circular wall of the body part of the circular magnetic permeability base. The sound coil is connected under the circular sound membrane, and the bass vibration audio source point is formed at the connecting part between the circular sound membrane and the sound coil. The sound coil extends into the magnetic gap which is formed between the off-centric first circular magnet and the off-centric second circular magnet. The bass sounding unit further includes a second wiring board which is adjoined with an outer bottom surface of the circular magnetic permeability base for fixing the connection wires of the sound coil.

Specifically, a ventilation hole is disposed at a bottom of the circular magnetic permeability base, for exhausting the air generated by the vibration of the vibration sounding membrane.

The off-axial audio speaking using one single audio source further includes an air flow damping gauze which is adhered at the outer bottom surface of the circular magnetic permeability base, for covering the ventilation hole and for adjusting the air flow of a chamber. The same audio speaker also has a dust-proof cover which is disposed on top of the bass sounding unit. The dust-proof cover includes a bass sound output hole. The sound of the bass sounding unit is outputted from the bass sound output hole of the dust-proof cover, and the treble sound could be outputted from the treble sound output hole of the treble sounding unit.

Specifically, the circular sound membrane is a composite material membrane.

Specifically, the bass sounding unit includes a magnetic permeability base. A treble sound positioning surface is hollow and is disposed at the off-centric position of the body of the magnetic permeability base. The two sides of the treble sound positioning surface include a long-axis sounding surface and a short-axis sounding surface. The body part of the magnetic permeability base has a top opening, and also has an auxiliary magnetic adjoining space and a sound coil movement space adjacent to the magnetic adjoining space. A separating wall is disposed between the auxiliary magnetic adjoining space and the sound coil movement space. The bass sounding unit further includes an off-centric circular magnet which is adjoined with the sound coil movement space and is far away from the separating wall, for forming a magnetic gap between the off-centric circular magnet and the separating wall. The same bass sounding unit also has an off-centric circular magnetic permeability ring fixed at the top of the off-centric circular magnet, for allowing the circular magnetic permeability ring and the magnetic permeability base to form an opening. The bass sounding unit further has an off-centric vibration sounding membrane including a hollow sound membrane. A sound coil is adjoined with the hollow sound membrane, and a bass vibration audio source point is formed at the connection part between the sound coil and the hollow sound membrane. The vibration sounding membrane is adjoined and fixed at the opening formed by the magnetic permeability base and the circular magnetic permeability ring, for enclosing the opening. Moreover, the sound coil extends into the sound coil movement space of the magnetic permeability base, and is positioned at the magnetic gap of the sound coil movement space. The bass sounding unit includes a second wiring board which adjoins with an outer bottom surface of the sound coil movement space of the magnetic permeability base, for fixing the leading wire of the sound coil.

Specifically, the vibration sounding membrane further includes an outer pressed edge and an inner pressed edge, and the circular sound membrane includes an outer circular edge and an inner circular edge. The outer pressed edge is fixed at the outer circular edge of the circular sound membrane, and the inner pressed edge is fixed at the inner circular edge of the circular sound membrane. The outer pressed edge also adjoins with the outer circular wall of the containing space of the magnetic permeability base, and the inner pressed edge adjoins with the inner circular wall of the containing space of the magnetic permeability base, allowing for the circular sound membrane to be positioned at the opening of the containing space and enclose the opening.

Specifically, a ventilation hole is disposed at a bottom of the sound coil movement space of the magnetic permeability base, for exhausting the air generated by the vibration of the vibration sounding membrane.

The off-axial audio speaker using a single audio source further includes an air flow damping gauze which is adhered to the outer bottom surface of the magnetic permeability base, for covering the ventilation hole and adjusting the air flow in a chamber. The same audio speaker also has a dust-proof cover which is adjoined on top of the bass sounding unit and the treble sounding unit. The sound of the bass sounding unit may be outputted from the bass sound output hole of the dust-proof cover.

Specifically, the auxiliary magnetic adjoining space of the magnetic permeability base is disposed near the treble sound positioning surface, and the sound coil movement space is disposed far away from the treble sound positioning surface. Moreover, an auxiliary magnet may be adjoined on the auxiliary magnetic adjoining space of the magnetic permeability base.

Specifically, the auxiliary magnetic adjoining space of the magnetic permeability base is disposed far away from the treble sound positioning surface, and the sound coil movement space is disposed near the position of the treble sound positioning surface. Moreover, an auxiliary magnet may be adjoined on the auxiliary magnetic adjoining space of the magnetic permeability base.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of a preferred embodiment corresponding with the reference Figures.

Figure 1:
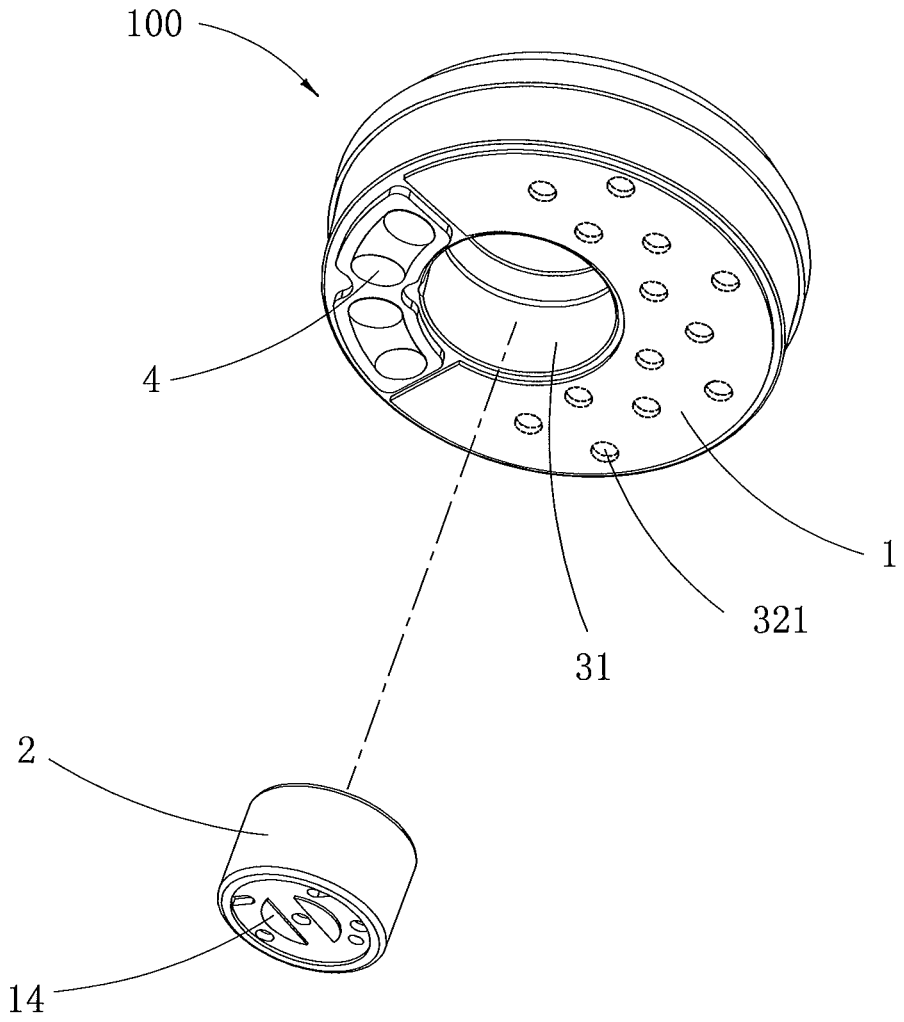
FIG. 1 shows a schematic diagram of an off-axial audio speaker using a single audio source according to an embodiment of the present disclosure.
Figure 2:
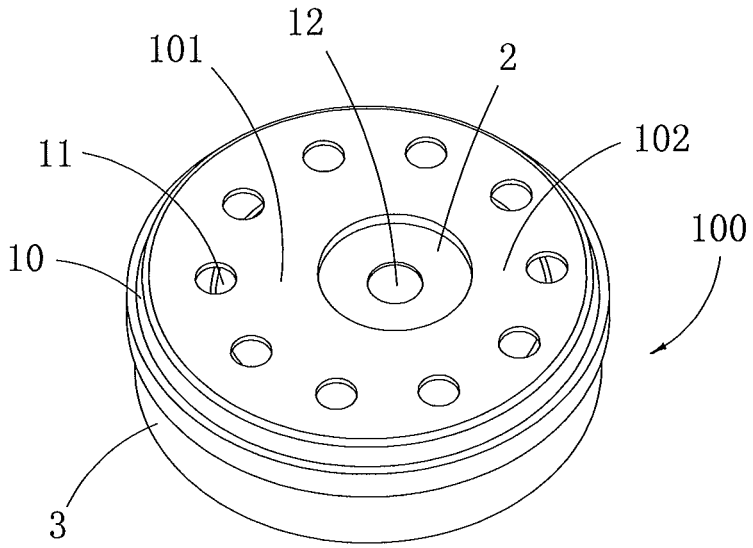
FIG. 2 shows a front three-dimensional diagram of an off-axial audio speaker using a single audio source according to an embodiment of the present disclosure.
Figure 3:
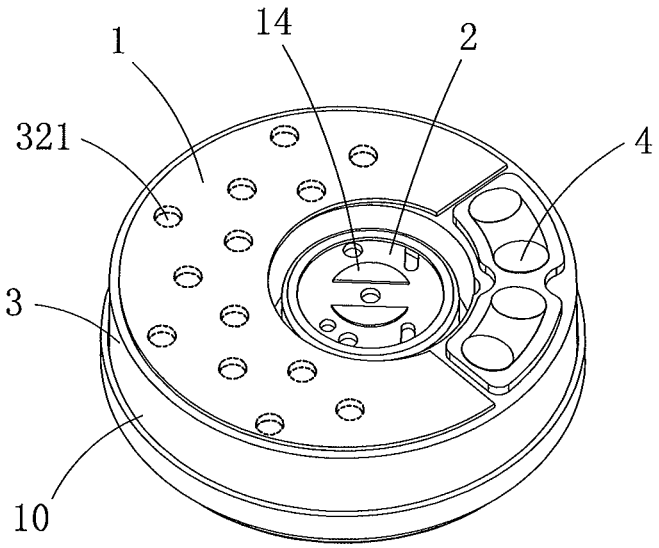
FIG. 3 shows a back three-dimensional diagram of an off-axial audio speaker using a single audio source according to an embodiment of the present disclosure.
Figure 4:
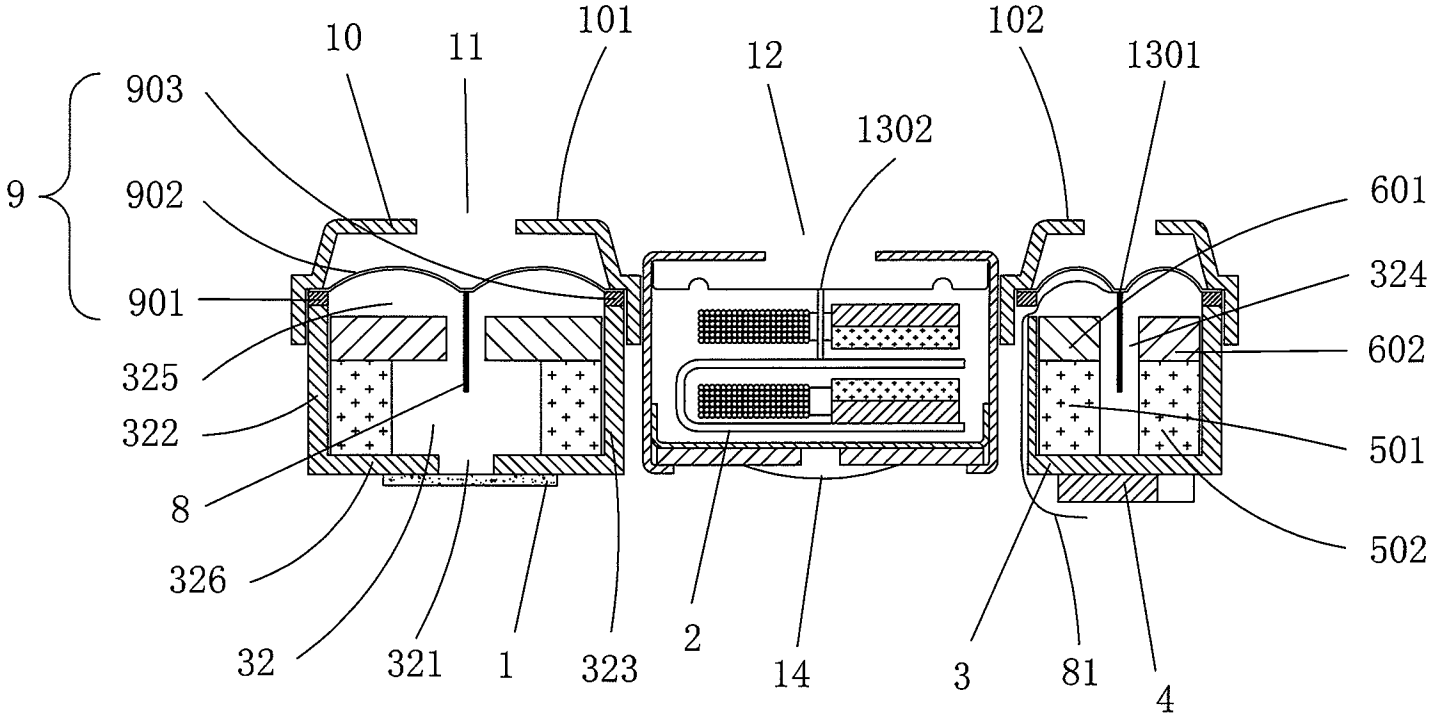
FIG. 4 shows a cross-sectional view of an off-axial audio speaker using a single audio source according to an embodiment of the present disclosure.

Please refer to FIGS. 1-4 illustrative of an off-axial audio speaker using a single audio source according to one embodiment of the present disclosure. The audio speaker includes a bass sounding unit 100 and a treble sounding unit 2. The bass sounding unit 100 is off-axially surrounded by the treble sounding unit 2. In this embodiment, the treble sounding unit 2 includes a treble vibration audio source point 1302 and a first wiring board 14, and a treble sound output hole 12 is disposed on the treble sounding unit 2. The treble sound output hole 12 is for outputting the sound of the treble sounding unit 2 (as shown in FIG. 4). The treble sounding unit 2 in this embodiment is a moving-iron treble sounding unit.

The bass sounding unit 100 is a single magnetic gap mechanism which includes a circular magnetic permeability base 3. A treble sound positioning surface 31 is hollow and is off-centrically disposed in the circular magnetic permeability base 3. Due to the off-centric disposition, the two sides of the treble sound positioning surface 31 include a long-axis sounding surface 101 and a short-axis sounding surface 102. The long-axis sounding surface 101 has relatively longer vibration area, for increasing the sounding area of the bass sounding unit 100 and realizing the optimal bass sound performance. The relatively superior bass sound may be-reached using the long-axis sounding surface 101 and the short-axis sounding surface 102. The body part of the circular magnetic permeability base 3 may define a containing space 32 which has a top opening 325. The body part of the circular magnetic permeability base 3 further includes an inner circular wall 323 and an outer circular wall 322 for defining the top opening 324, and a bottom surface 326 disposed away from the top opening 325. A ventilation hole 321 is disposed on the bottom surface 326.

A first circular magnet 501 and a second circular magnet 502 are positioned at the containing space 32 of the circular magnetic permeability base 3. The area of the first circular magnet 501 is smaller than the area of the second circular magnet 502, and the width and the height of the cross-section of the first circular magnet 501 and the second circular magnet 502 may be smaller than the width and the height of the containing space 32. The bottom of the first circular magnet 501 and the second circular magnet 502 may be fixed and disposed at the bottom surface of the containing space 32. The first circular magnet 501 is adjoined with the wall surface of the inner circular wall 323 of the containing space 32, and the second circular magnet 502 is adjoined with the wall surface of the outer circular wall 322, for allowing the first circular magnet 501 and the second circular magnet 502 to define a magnetic gap 324 within the containing space 32.

A first magnetic permeability ring 601 and a second magnetic permeability ring 602 may be included in the present embodiment. The first magnetic permeability ring 601 is adhered and fixed on the upper surface of the first circular magnet 501, and the second magnetic permeability ring 602 is adhered and fixed on the upper surface of the second circular magnet 502. Thus, the first circular magnet 501, the second circular magnet 502, the first magnetic permeability ring 601, and the second magnetic permeability ring 602 may be disposed and positioned within the containing space 32 of the magnetic permeability base 3. The first magnetic permeability ring 601 and the second magnetic permeability ring 602 do not protrude out of the opening 325 of the magnetic permeability base 3.

The opening 325 of the magnetic permeability base 3 is adjoined with a vibration sounding membrane 9. The vibration sounding membrane 9 includes a circular outer pressed edge 901, a circular sound membrane 902, and a circular inner pressed edge 903. The circular sound membrane 902 includes an outer circular edge and an inner circular edge. The circular outer pressed edge 901 is fixed on the outer circular edge, and the circular inner pressed edge 903 is fixed on the inner circular edge. A sound coil 8 is adjoined under the circular sound membrane 902. The sound coil 8 is positioned between the outer pressed edge 901 and the inner pressed edge 903, and the adjoining part between the sound coil 8 and the circular sound membrane 902 is a bass vibration audio source point 1301. The outer pressed edge 901 of the vibration sounding membrane 9 is fixed and adjoined with the outer circular wall 322 of the opening 325 of the magnetic permeability base 3, and the inner pressed edge 903 is fixed and adjoined with the inner circular wall 323, for positioning the sound coil 8 in the containing space 32 of the magnetic permeability base 3 and in the magnetic gap 324 defined between the first circular magnet 501 and the second circular magnet 502. Moreover, the vibration sounding membrane 9 may enclose the opening 325 of the containing space 32 of the magnetic permeability base 3.

In addition, the first circular magnet 501, the second circular magnet 502, the first magnetic permeability ring 601, the second magnetic permeability ring 602, and the vibration sounding membrane 9 may be all implemented in terms of an off-centric circular-shaped body. Therefore, they may be adjoined within the off-centric circular magnetic permeability base 3 without difficulty.

The first circular magnet 501 and the second circular magnet 502 are for providing the magnetic field, and the first magnetic permeability ring 601 and the second magnetic permeability ring 602 are for enabling the magnetic permeability. The sound coil 8 provides magnetic gap loop, and achieves the magnetic permeability effect by the magnetic permeability base 3. The ventilation hole 321 is for exhausting air generated by the vibration of the vibration sounding membrane 9.

In addition, a second wiring board 4 may be adhered to the outer wall surface of the bottom surface 326 of the magnetic permeability base 3 which is not disposed with the ventilation hole 321. The second wiring board 4 is for welding and fixing the leading wire 81 of the sound coil 8, in order to form the electrical circuit loop.

Moreover, an air flow damping gauze 1 may be adhered to the outer wall surface of the bottom surface 326 of the magnetic permeability base 3 having the ventilation hole 321. The air flow damping gauze 1 is for covering the ventilation hole 321, for adjusting the air flow in the containing space 32 of the magnetic permeability base 3.

The treble sounding unit 2 is adjoined in the treble sound positioning surface 31 which is hollow and off-centrically disposed in the magnetic permeability base 3 by the adjoining means. The adjoining means may be adhering, buckling, or fastening, etc. The bass sounding unit 100 is surrounded by the treble sounding unit 2. The relatively superior bass sound performance may result using the long-axis sounding surface 101 of the bass sounding unit 100, and by collocating the bass sound and the treble sound outputted by the treble sounding unit 2, a relatively broader bandwidth of the sound may be acquired. Moreover, the bass vibration audio source point 1301 of the bass sounding unit 100 and the treble vibration audio source point 1302 of the treble sounding unit 2 are aligned to the same horizontal reference level. Therefore, the sounding units may have relatively broader electrical adjustability, and the off-axial audio speaker using one single audio source may be able to output both the bass sound and the treble sound.

Figure 5:
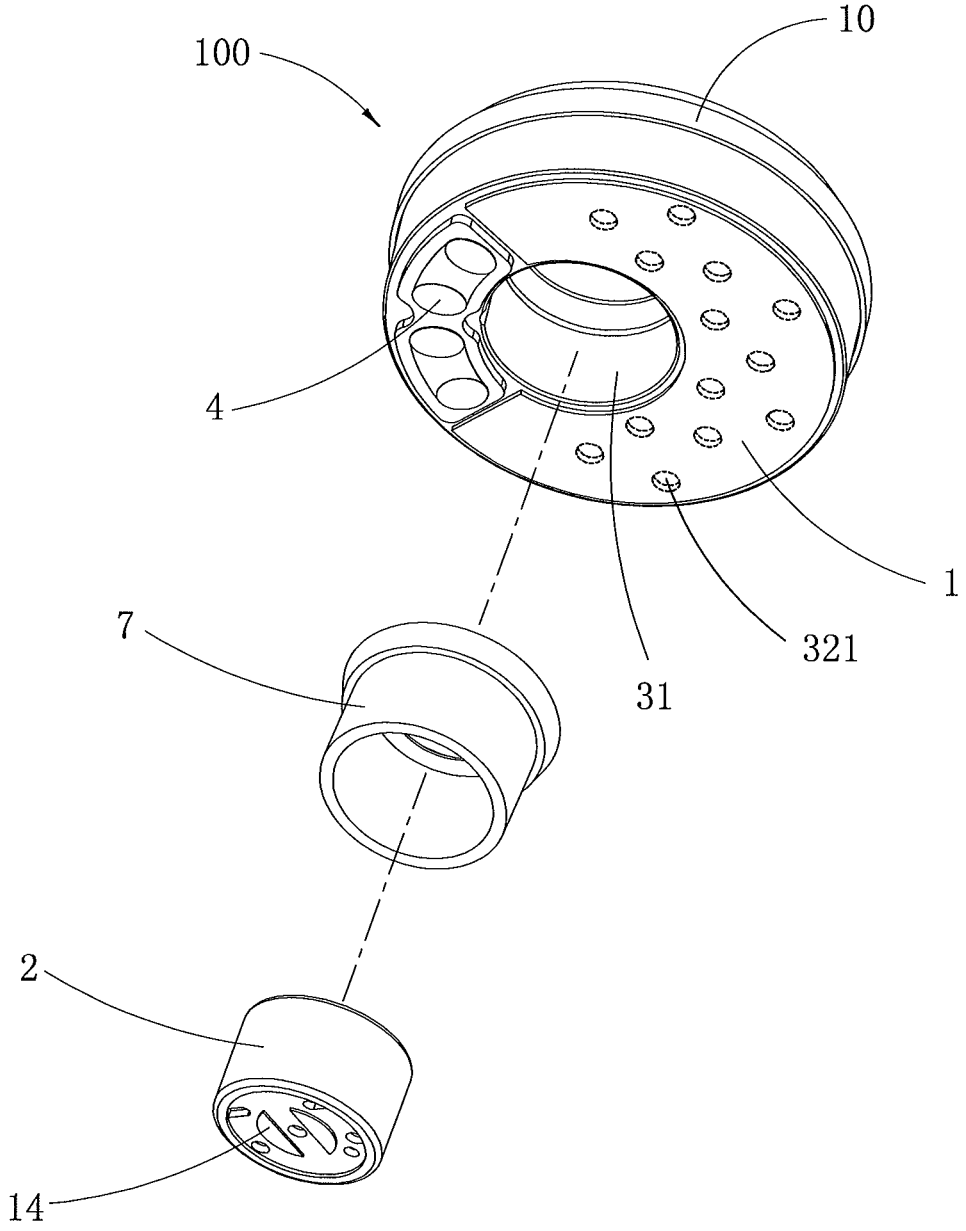
FIG. 5 shows a schematic diagram of an off-axial audio speaker using a single audio source according to another embodiment of the present disclosure.
Figure 6:
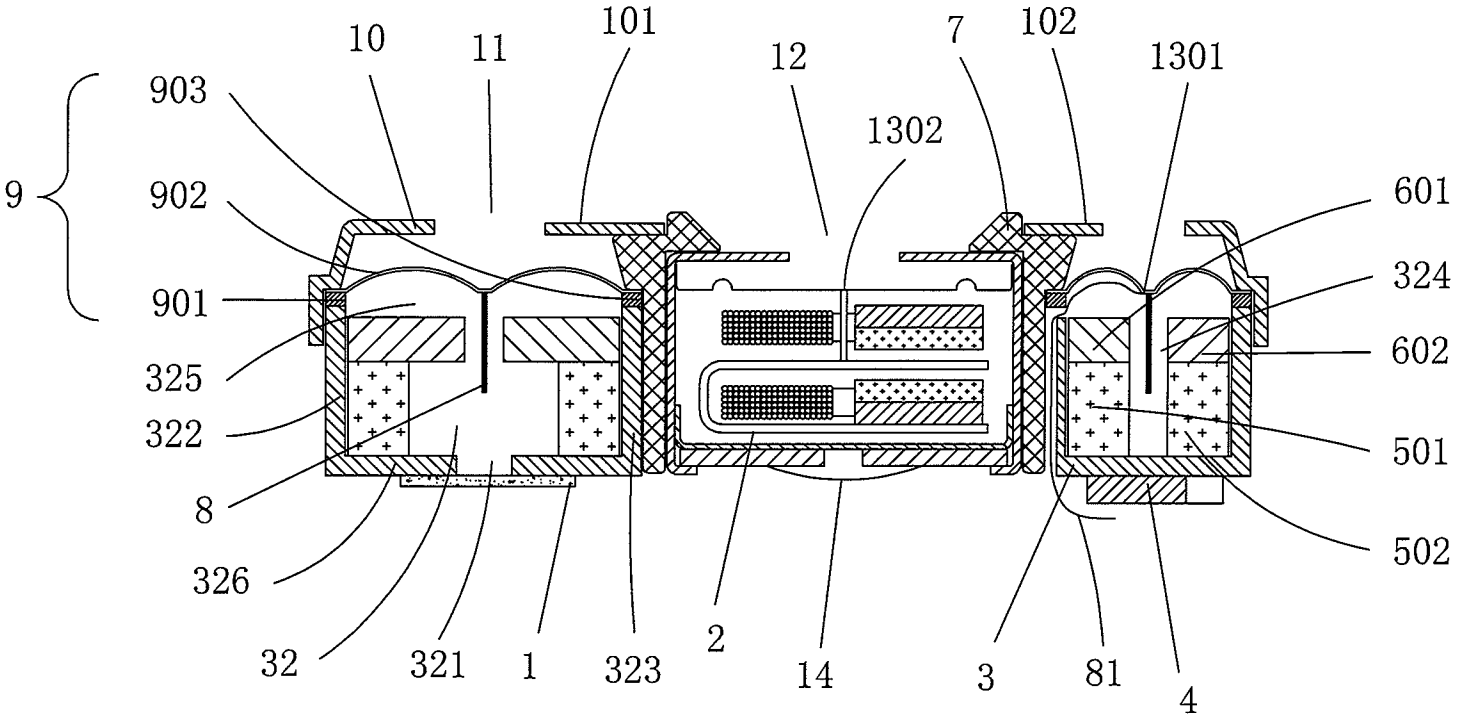
FIG. 6 shows a cross-sectional diagram of an off-axial audio speaker using a single audio source according to another embodiment of the present disclosure.

Please refer to FIG. 5 along with FIG. 6. The differences between the FIGS. 5-6 and the FIGS. 1-4 include that a magnetic resistance ring 7 is disposed at the surrounding and adjoining part of the bass sounding unit 100 and the treble sounding unit 2. The magnetic resistance ring 7 is a sleeve structure. The treble sounding unit 2 may cross and positioned in an inner part of the magnetic resistance ring 7, and the magnetic permeability base 3 of the bass sounding unit 100 may be surrounded by and fixed at an outer part of the magnetic resistance ring 7. Therefore, the magnetic resistance ring 7 is able to separate the magnetic field of the bass sounding unit 100 from the magnetic field of the treble sounding unit 2. The remaining structures shown in FIGS. 5-6 are similar to their counterparts in FIGS. 1-4.

Figure 7:
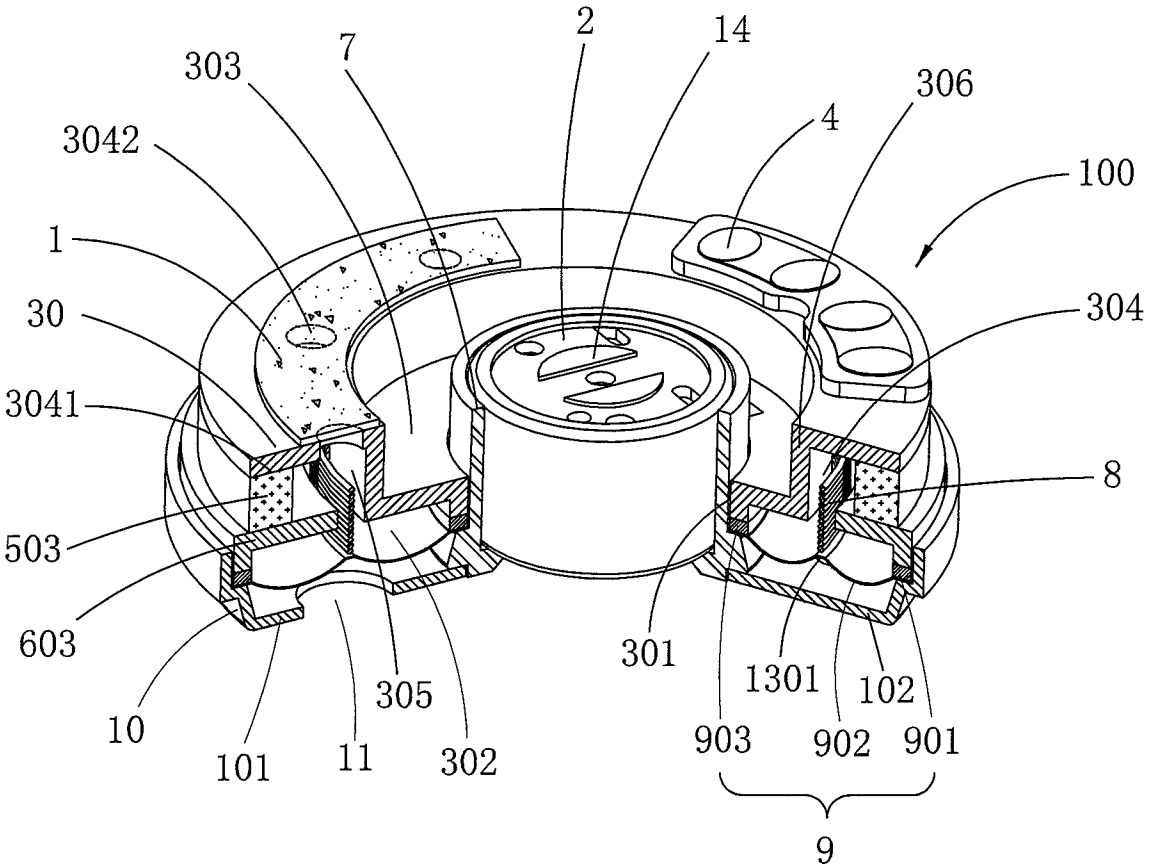
FIG. 7 shows a partial cross-sectional diagram of an off-axial audio speaker using a single audio source according to another embodiment of the present disclosure.

Please refer to FIG. 7 which shows another embodiment according to the present disclosure. An off-centric part of the circular magnetic permeability base 30 of the bass sounding unit 100 is a hollow treble sound positioning surface 301. Because of the off-axial disposition of the treble sound positioning surface 301, the treble sound positioning surface 301 may include a long-axis sounding surface 101 and a short-axis sounding surface 102. The long-axis sounding surface 101 has relatively longer vibration area, for increasing the sounding area of the bass sounding unit 100, to-reach the optimal bass sound performance. The relatively superior bass sound may be-reached using the long-axis sounding surface 101 and the short-axis sounding surface 102. The body part of the magnetic permeability base 30 includes an auxiliary magnetic adjoining space 303 and a sound coil movement space 304. A separating wall 306 is located between the auxiliary magnetic adjoining space 303 and the sound coil movement space 304. Consequently, the cross-section of the magnetic permeability base 30 may be Z-shaped. In addition, a ventilation hole 3042 is disposed at an adjoining surface 3041 of the sound coil movement space 304. As the magnetic permeability base 30 shown in FIG. 7, the auxiliary magnetic adjoining space 303 is disposed near the treble sound positioning surface 301, and the sound coil movement surface 304 is disposed away from the treble sound positioning surface 301.

An off-centric circular magnet 503 is adjoined and fixed at the adjoining surface 3041 of the sound coil movement space 304 of the magnetic permeability base 30. The width and height of the cross-section of the off-centric circular magnet 503 may be smaller than the width and height of the sound coil movement space 304. The off-centric circular magnet 503 is adjoined to the sound coil movement space 304 and is away from the auxiliary magnetic adjoining space 303. Because the width of the off-centric circular magnet 503 is smaller than the width of the sound coil movement space 304, the off-centric circular magnet 503 may not entirely occupy the entire sound coil movement space 304, enabling a magnetic gap 305 to be formed at the place of the separating wall 306 that is in the proximity of the auxiliary magnetic adjoining space 304.

An off-centric circular magnetic permeability ring 603 is also shown in the figures. The magnetic permeability ring 603 is adhered and fixed to the top surface of the circular magnet 503, and is positioned and disposed in the sound coil movement 304 of the magnetic permeability base 30.

An opening 302 may be formed between the magnetic permeability ring 603 and the magnetic permeability base 30. An off-centric vibration sounding membrane 9 is adjoined on the opening 302, and includes a circular outer pressed edge 901, a hollow sound membrane 902, and a circular inner pressed edge 903. The hollow sound membrane 902 has an outer circular edge and an inner circular edge. The outer circular edge is fixed on top of the outer pressed edge 901, and the inner circular edge is fixed on top of the inner pressed edge 903. Moreover, a sound coil 8 is adjoined with the hollow sound membrane 902. The sound coil 8 is positioned between the outer pressed edge 901 and the inner pressed edge 903, and the adjoining part between the sound coil 8 and the hollow sound membrane 902 is a bass vibration audio source point 1301. The outer pressed edge 901 and the inner pressed edge 903 of the vibration sounding membrane 9 are respectively adjoined in the outer edge and the inner edge of the opening 302 of the magnetic permeability base 30. Therefore, the sound coil 8 may be positioned in the sound coil movement space 304 of the magnetic permeability base 30, and also be positioned in the magnetic gap 305 between the circular magnet 503 and the separating wall 306. In addition, the vibration sounding membrane 9 may enclose the opening 302 of the magnetic permeability base 30.

Figure 8:
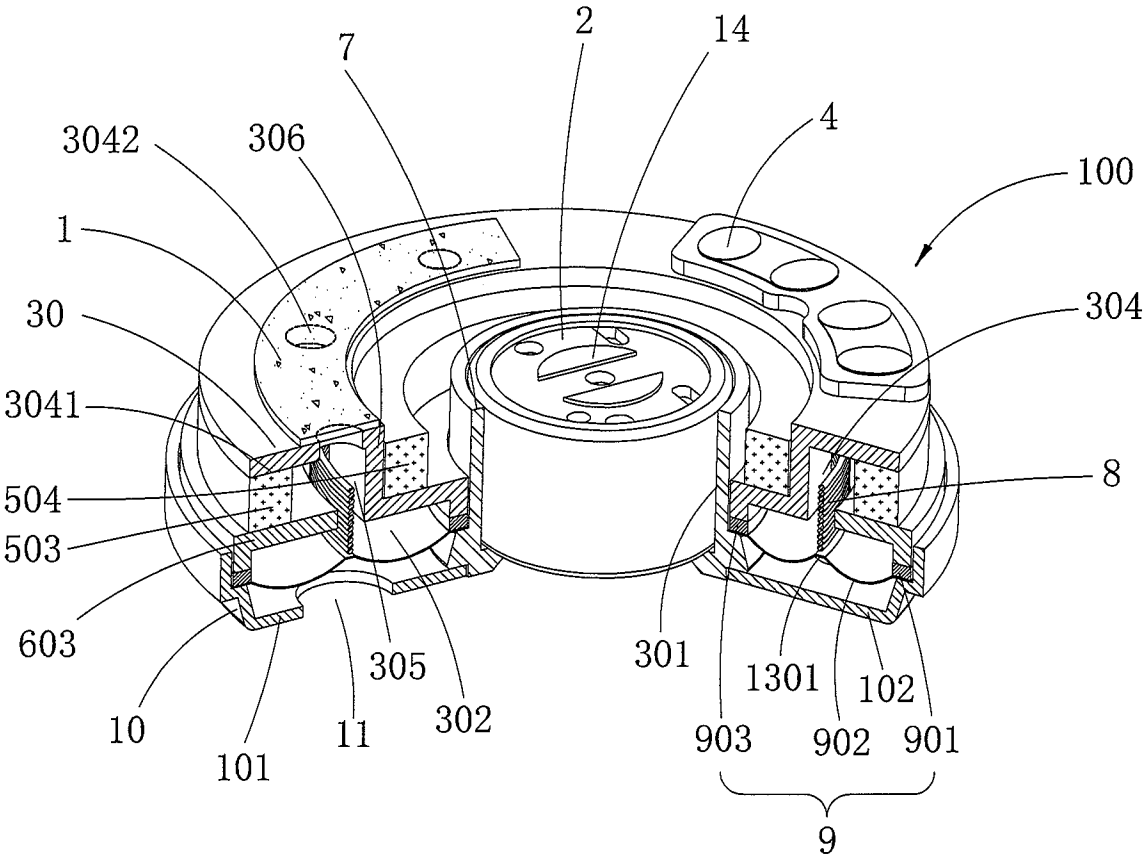
FIG. 8 shows a partial cross-sectional diagram of an off-axial audio speaker using a single audio source according to another embodiment of the present disclosure.

Please refer to FIG. 8 showing a schematic diagram of another embodiment according to the present disclosure. An auxiliary magnet 504 may be adjoined and fixed at the auxiliary magnetic adjoining space 303. The area of the auxiliary magnet 504 is smaller than the area of the circular magnet 503, and the width and height of the cross-section of the auxiliary magnet 504 is respectively smaller than the width and height of the cross-section of the sound coil movement space 304. With the auxiliary magnet 504 along with the magnetic permeability effectuated by the magnetic permeability base 30, the total magnetism may enhance. The remaining structures shown in FIG. 8 are similar to their counterparts in FIG. 7.

Figure 9:
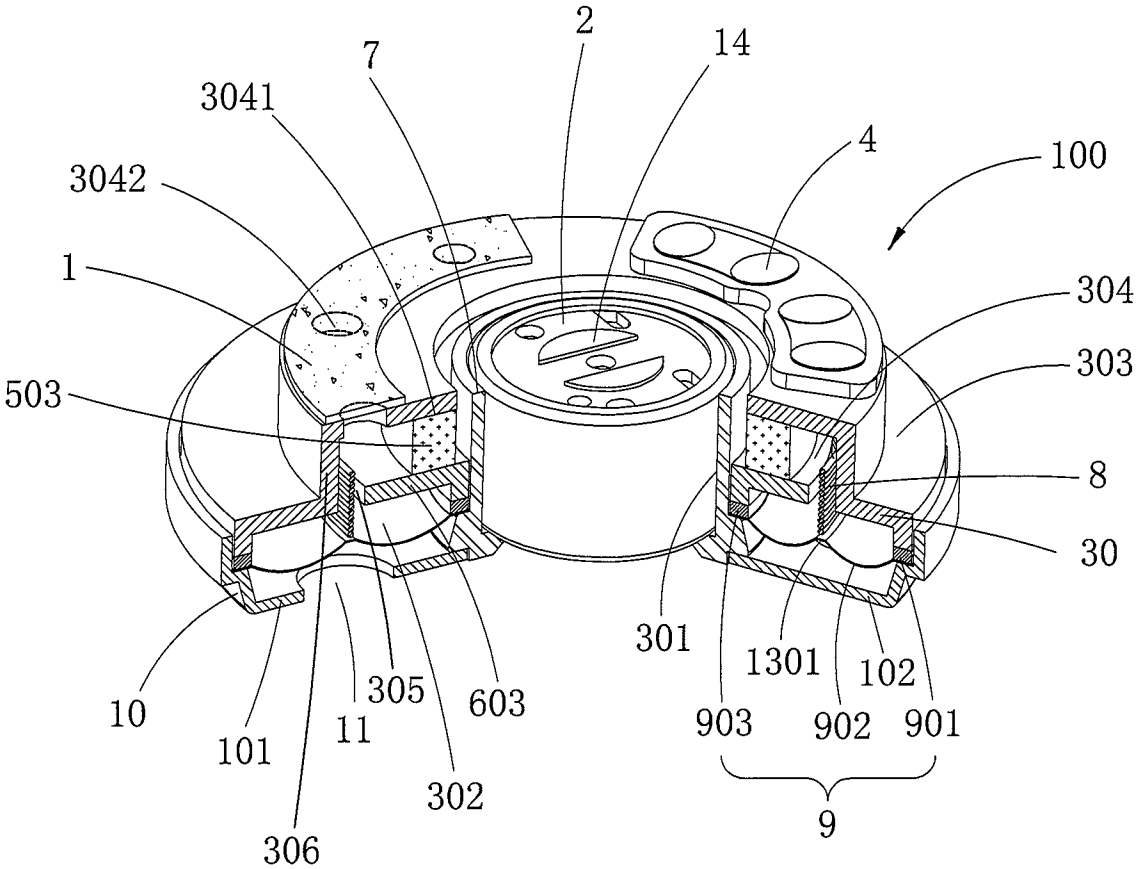
FIG. 9 shows a partial cross-sectional diagram of an off-axial audio speaker using a single audio source according to another embodiment of the present disclosure.

Please refer to FIG. 9. The differences between FIG. 9 and FIGS. 7-8 may include the positional arrangement of the sound coil movement space. For example, the sound coil movement space 304 in FIG. 9 may be positioned near to the treble sound positioning surface 301, and the auxiliary magnetic adjoining space 303 in FIG. 9 may be positioned away from the treble sound positioning surface 301. The direction of the cross-section in FIG. 9 is opposite to its counterparts in FIGS. 7 and 8, and the remaining structures in FIG. 9 are similar to those in FIGS. 7 and 8.

Figure 10:
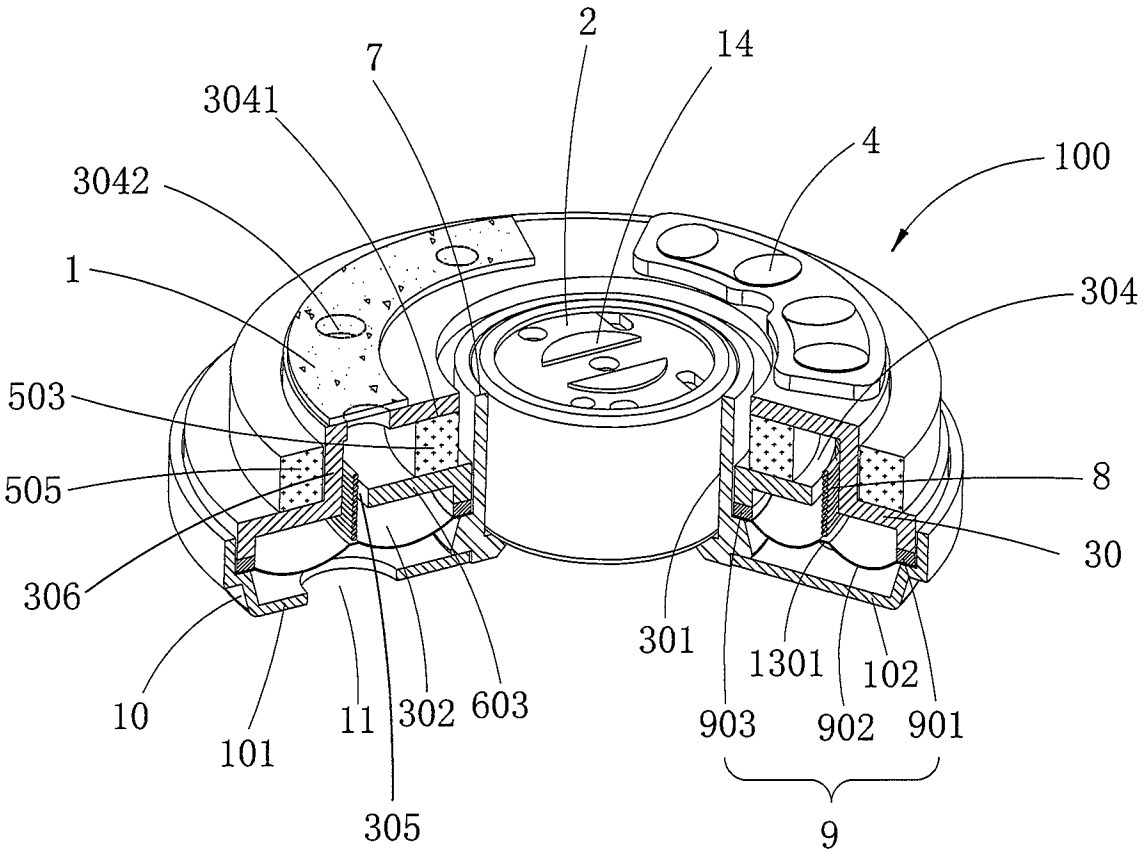
FIG. 10 shows a partial cross-sectional diagram of an off-axial audio speaker using a single audio source according to another embodiment of the present disclosure.

As shown in FIG. 10, an auxiliary magnet 505 may be disposed and fixed at the auxiliary magnetic adjoining space 303 which is away from the treble sound positioning surface 301, without affecting the result described in FIG. 9. The remaining structures in FIG. 10 are similar to their counterparts in FIG. 9.

Figure 11:
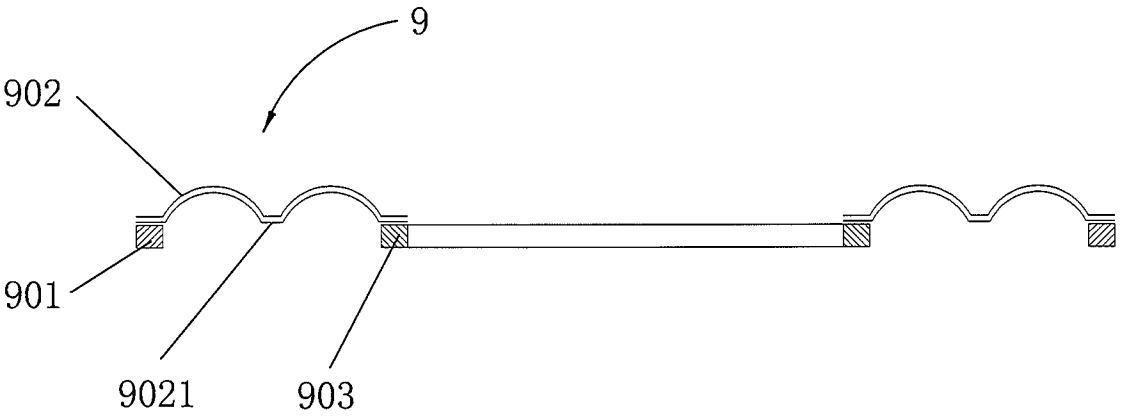
FIG. 11 shows a schematic diagram of a vibration sounding membrane of an off-axial audio speaker using a single audio source according to the present disclosure.

Please refer to FIG. 11. The circular sound membrane 902 in FIGS. 1-10 may be a composite material membrane 9021. In addition, the materials used by the circular sound membrane 902 may be the high molecular plastic, the high molecular plastic fiber, the organic fiber, or the mineral matter, etc. The mineral matters may be the metal, the rock, the mineral, or the glass, etc. The materials of the composite material membrane 9021 may be formed in membrane-shape or weaving-shaped, and may be one or multiple combinations chosen from the implementations described above. Moreover, the shapes of the outer pressed edge 901 and the inner pressed edge 903 are not limited to being circular. The circular-shaped edge is just one implementation of the present disclosure, and it is not for limiting the scope of the present disclosure. The shape of the outer pressed edge 901 or the inner pressed edge may be an elliptic shape, a triangle, a rectangle, a polygon, or other geometric graphics.

In addition, a second wiring board 4 may be adhered on the outer wall surface of the sound coil movement space 304 of the magnetic permeability base 30. The second wiring board 4 is for welding and fixing the leading wire 81 of the sound coil 8, to implement the electrical circuit loop.

Moreover, the adjoining means between the treble sounding unit 2 and the magnetic resistance ring 7, the magnetic permeability base 3, or the magnetic permeability base 30 may be adhering, buckling, or fastening, etc., for surrounding the treble sounding unit 2 with the bass sounding unit 100. The bass sounding unit 100 and the treble sounding unit 2 are off-centrically disposed together, and the bass vibration audio source point 1301 of the bass sounding unit 100 and the treble vibration audio source point 1302 of the treble sounding unit 2 are aligned to the same horizontal reference level. Therefore, the sounding units may have relatively broader range of electrical adjustability, and the off-axial audio speaker using one single audio source may be able to output both the bass sound and the treble sound at the same time.

In addition, the first wiring board 14 of the treble sounding unit 2 and the second wiring board 4 of the bass sounding unit 100 which are magnetized are connected with electrical signal lines.

In addition, an air flow damping gauze 1 may further be adhered to the outer bottom surface of the sound coil movement space 304 of the magnetic permeability base 30. The air flow damping gauze 1 covers the ventilation hole 3042, for adjusting the air flow in the sound coil movement space 304 of the magnetic permeability base 30.

In addition, a dust-proof cover 10 is disposed above the bass sounding unit 100 as shown in FIGS. 1 to 10. The dust-proof cover 10 has a bass sound output hole 11, and the sound of the bass sounding unit 100 are outputted from the bass sound output hole 11.

Figure 12A:
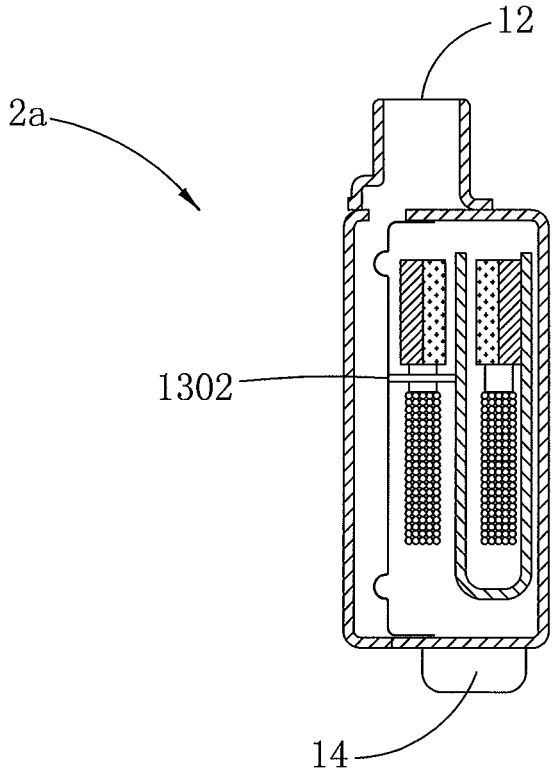
FIGS. 12A-12F show several schematic diagrams of several treble sounding units of an off-axial audio speaker using a single audio source according to the present disclosure.
Figure 12B:
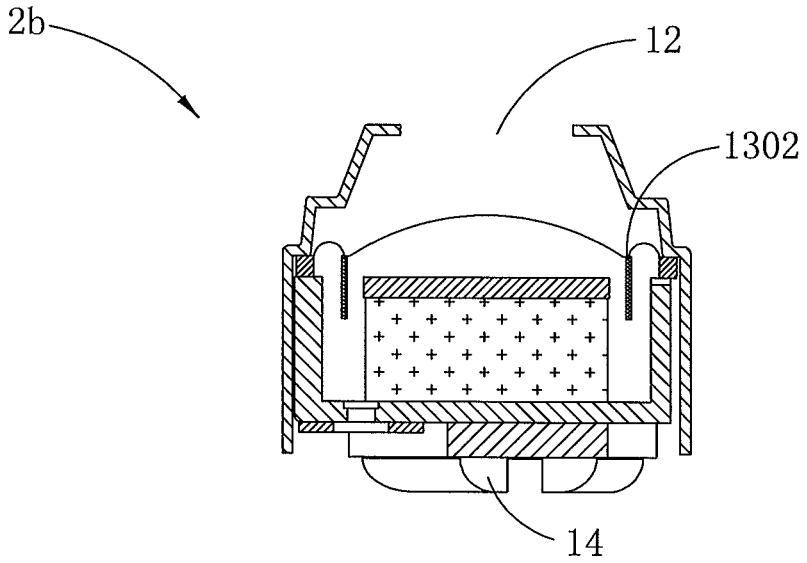
Figure 12C:
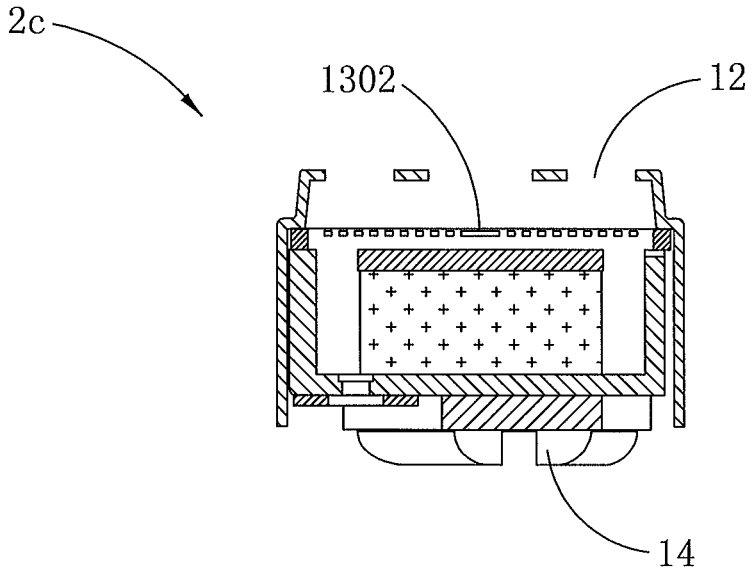
Figure 12D:
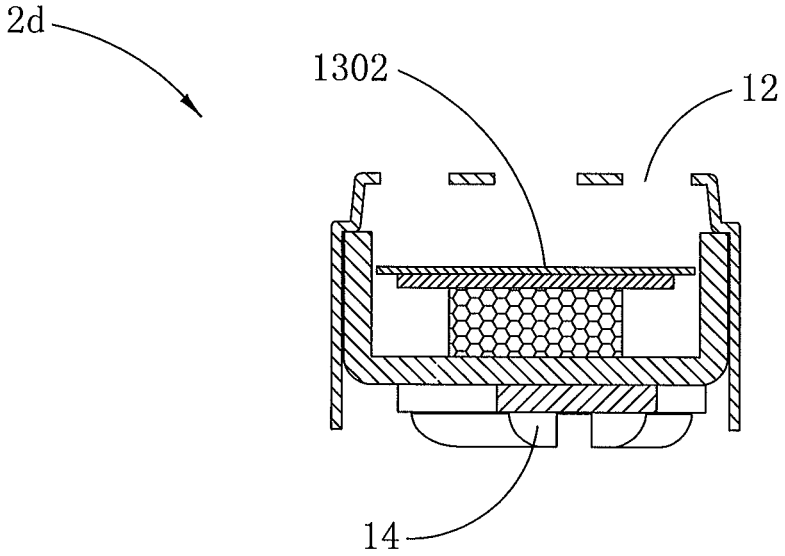
Figure 12E:
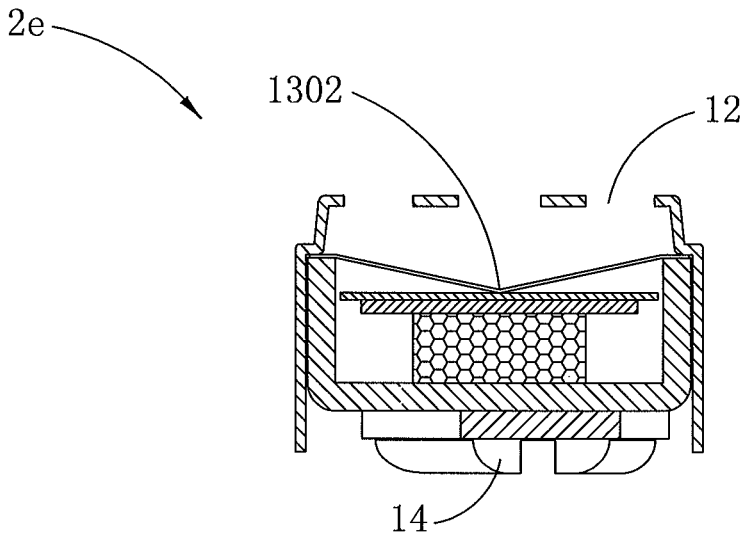
Figure 12F:
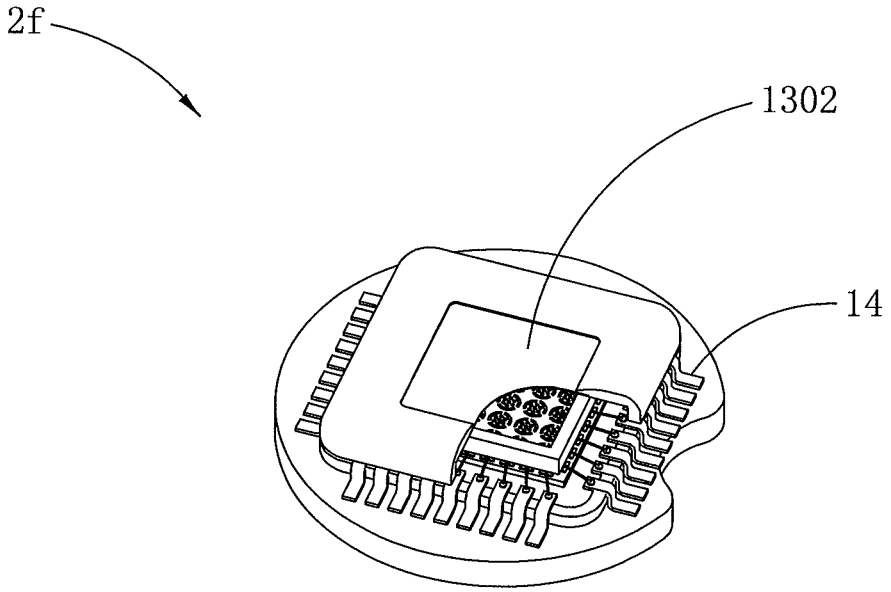

Please refer to FIGS. 12A-12F. The treble sounding unit 2 may be a moving-iron treble sounding unit, a rectangular electromagnetic moving-iron sounding unit 2*a* (as shown in FIG. 12A), a moving-coil sounding unit 2*b* (as shown in FIG. 12B), a ribbon-type sounding unit 2*c* (as shown in FIG. 12C), a piezoelectric ceramic sounding component 2*d* (as shown in FIG. 12D), a piezoelectric ceramic sounding piece adjoining with a vibration sounding membrane 2*e* (as shown in FIG. 12E), or a semiconductor chip sounding unit 2*f* (as shown in FIG. 12F). Moreover, the treble sounding units 2*a* to 2*f* shown in FIGS. 12A to 12F all include the first wiring boards 14 and the treble vibration audio source points 1302. The treble sounding units 2*a* to 2*e* except the semiconductor chip sounding unit 2*f* are all disposed with the treble sound output holes 12. The aforementioned treble sounding unit 2 is just one embodiment of the present disclosure, and is not for limiting the scope of the present disclosure.

In addition, the embodiments shown in FIGS. 1 to 12F may be applied to all kinds of speaker products or earphone products. The earphone products include in-ear headphones, ear canal headphones, back neck earphones, and headphones.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. An off-axial audio speaker using single audio source, comprising:

a treble sounding unit including a treble vibration audio source point, a treble sound output hole, and a first wiring board; and a bass sounding unit including a hollow treble sound positioning surface and off-centrically disposed with respect to the treble sounding unit, for the treble sound positioning surface to be with a long axis sounding surface and a short axis sounding surface, wherein the long axis sounding surface includes long vibration area for increasing a sounding area of the bass sounding unit, and a sounding body includes a magnet, a sound coil, a vibration sounding membrane, and a bass vibration audio source point, all of which is incorporated into the bass sounding unit;

wherein the treble sounding unit is disposed at the treble sound positioning surface of the bass sounding unit allowing for the treble sounding unit to be off-axially positioned in the bass sounding unit, and the bass vibration audio source point of the bass sounding unit and the treble vibration audio source point of the treble sounding unit are aligned with the same horizontal reference level.

2. The off-axial audio speaker using the single audio source according to claim 1, wherein the treble sounding unit is a moving-iron sounding unit, a circular electromagnetic moving-iron sounding unit, a rectangular electromagnetic moving-iron sounding unit, a moving-coil sounding unit, a ribbon-type sounding unit, a piezoelectric ceramic sounding piece component, a piezoelectric ceramic sounding piece adjoining another vibration sounding membrane, or a semiconductor chip sounding unit.

3. The off-axial audio speaker using the single audio source according to claim 1, further comprising a magnetic resistance ring disposed at an surrounding and adjoining part between the treble sounding unit and the bass sounding unit, for separating a magnetic field of the bass sounding unit and a magnetic field of the treble sounding unit.

4. The off-axial audio speaker using the single audio source according to claim 3, wherein the magnetic resistance ring is a sleeve structure including an inner part for the treble sounding unit to cross and to be positioned and an outer part for a magnetic permeability base of the bass sounding unit to surround and to be fixed at.

5. The off-axial audio speaker using the single audio source according to claim 1, wherein the bass sounding unit further includes:

a circular magnetic permeability base, wherein the treble sound positioning surface is disposed at an off-centric position of the circular magnetic permeability base, the treble sound positioning surface is for the treble sounding unit to surround and to be fixed at, the two sides of the treble sound positioning surface include the long axis sounding surface and the short axis sounding surface, a body part of the circular magnetic permeability base includes a circular containing space with a top opening, and the body part of the circular magnetic permeability base includes an inner circular wall and an outer circular wall for defining the circular containing space;

an off-centric first circular magnet and an off-centric second circular magnet, wherein the off-centric first circular magnet is disposed and adjoined with the inner circular wall of the circular containing space, the off-centric second circular magnet is disposed and adjoined with the outer circular wall, and a magnetic gap is defined between the off-centric first circular magnet and the off-centric second circular magnet;

an off-centric first magnetic permeability ring and an off-centric second magnetic permeability ring, wherein the off-centric first magnetic permeability ring is fixed at an upper surface of the off-centric first circular magnet, and the off-centric second magnetic permeability ring is fixed at an upper surface of the off-centric second circular magnet;

the vibration sounding membrane including a circular sound membrane fixed at an edge of the inner circular wall and the outer circular wall of the body part of the circular magnetic permeability base, wherein a sound coil is connected under the circular sound membrane, the bass vibration audio source point is formed at the connection part between the sound coil and the circular sound membrane, and the sound coil extends into the magnetic gap defined between the off-centric first circular magnet and the off-centric second circular magnet; and a second wiring board connecting with an outer bottom surface of the circular magnetic permeability base, to provide a connecting wire for fixing the sound coil.

6. The off-axial audio speaker using the single audio source according to claim 5, wherein the vibration sounding membrane further includes an outer pressed edge and an inner pressed edge, wherein the outer pressed edge is fixed at an outer circular edge of the circular sound membrane, the inner pressed edge is fixed at an inner circular edge of the circular sound membrane, the outer pressed edge is connected with the edge of the outer circular wall of the circular magnetic permeability base, the inner pressed edge is connected with the edge of the inner circular wall of the circular magnetic permeability base, and the circular magnetic permeability base is enclosed at an opening.

7. The off-axial audio speaker using the single audio source according to claim 5, wherein the outer bottom surface of the circular magnetic permeability base includes a ventilation hole, for exhausting air generated by the vibration of the vibration sounding membrane out of the circular containing space.

8. The off-axial audio speaker using the single audio source according to claim 7, further comprising:

an air flow damping gauze adhered to the outer bottom surface of the circular magnetic permeability base, for covering the ventilation hole and adjusting an air flow in a chamber; and a dust-proof cover disposed on top of the bass sounding unit, wherein the dust-proof cover includes a bass sound output hole, bass sound of the bass sounding unit is outputted from the bass sound output hole of the dust-proof cover, and treble sound is outputted from the treble sound output hole of the treble sounding unit.

9. The off-axial audio speaker using the single audio source according to claim 5, wherein the circular sound membrane is a composite material membrane.

10. The off-axial audio speaker using the single audio source according to claim 1, wherein the bass sounding unit includes:

a magnetic permeability base, wherein a hollow treble sound positioning surface disposed at an off-centric location of the magnetic permeability base, the treble sounding unit includes the long axis sounding surface and the short axis sounding surface, a body part of the magnetic permeability base has a top opening, the body part of the magnetic permeability base includes an auxiliary magnetic adjoining space and a sound coil movement space adjacent to the auxiliary adjoining space, and a separating wall is disposed between the auxiliary magnetic adjoining space and the sound coil movement space;

an off-centric circular magnet adjoining with the sound coil movement space and separated away from the separating wall, for enabling the off-centric circular magnet and the separating wall to define a magnetic gap;

an off-centric circular magnetic permeability ring fixed at the top of the off-centric circular magnet, for the off-centric circular magnetic permeability ring and the magnetic permeability base to define an opening;

an off-centric vibration sounding membrane including a hollow sound membrane, wherein the sound coil is connected with the hollow sound membrane, a bass vibration audio source point is formed at the connecting part of the sound coil and the hollow sound membrane, the off-centric vibration sounding membrane is adjoined and fixed at the opening defined by the magnetic permeability base and the off-centric circular magnetic permeability ring for enclosing the opening, the sound coil extends into the sound coil movement space of the magnetic permeability base, and is positioned in the magnetic gap of the sound coil movement space; and a second wiring board adjoining on an outer bottom surface of the sound coil movement space of the magnetic permeability base, for fixing the leading wire of the sound coil.

11. The off-axial audio speaker using the single audio source according to claim 10, wherein the off-centric vibration sounding membrane further includes an outer pressed edge and an inner pressed edge, the hollow sound membrane has an outer circular edge and an inner circular edge, the outer pressed edge is fixed at the outer circular edge of the hollow sound membrane and the inner pressed edge is fixed at the inner circular edge of the hollow sound membrane, allowing for the outer pressed edge to be adjoined at an outer circular wall of a containing space of the magnetic permeability base and the inner pressed edge to be adjoined at an inner circular wall of the containing space, and the hollow sound membrane is positioned at an opening of the containing space for enclosing the opening of the containing space.

12. The off-axial audio speaker using the single audio source according to claim 10, wherein a ventilation hole is disposed at a bottom of the sound coil movement space of the magnetic permeability, for exhausting air generated by the vibration of the off-centric vibration sounding membrane out of the sound coil movement space.

13. The off-axial audio speaker using the single audio source according to claim 10, further comprising:

an air flow damping gauze adhered to an outer bottom surface of the magnetic permeability base, for covering a ventilation hole and adjusting the air flow of a chamber; and a dust-proof cover adjoining on top of the bass sounding unit and the treble sounding unit, and bass sound of the bass sounding unit being outputted from a bass sound output hole of the dust-proof cover.

14. The off-axial audio speaker using the single audio source according to claim 10, wherein the auxiliary magnetic adjoining space of the magnetic permeability base is disposed near the treble sound positioning surface and the sound coil movement space is disposed away from the treble sound positioning surface.

15. The off-axial audio speaker using the single audio source according to claim 14, wherein an auxiliary magnet is adjoined to the auxiliary magnetic adjoining space of the magnetic permeability base.

16. The off-axial audio speaker using the single audio source according to claim 10, wherein the auxiliary magnetic adjoining space is disposed away from the treble sound positioning surface and the sound coil movement space is disposed in the proximity of the treble sound positioning surface.

17. The off-axial audio speaker using the single audio source according to claim 16, wherein an auxiliary magnet is adjoined with the auxiliary magnetic adjoining space of the magnetic permeability base.

* * * * *